US006152000A

United States Patent [19]

Mowins

[11] Patent Number: 6,152,000

[45] Date of Patent: Nov. 28, 2000

[54] DRIVER BIT AND DRIVER

[75] Inventor: Michael L. Mowins, Gloucester, Mass.

[73] Assignee: Phillips Screw Company, Wakefield, Mass.

[21] Appl. No.: 09/149,696

[22] Filed: Sep. 8, 1998

[51] Int. Cl.[7] ..... B25B 23/08

[52] U.S. Cl. ..... 81/441; 81/436

[58] Field of Search ..... 81/436, 441, 459–461

[56] References Cited

U.S. PATENT DOCUMENTS

| | | | |
|---|---|---|---|
| 1,738,405 | 12/1929 | Thal | 81/436 |
| 1,844,241 | 2/1932 | Bryant | 81/441 |
| 1,899,489 | 2/1933 | Wickberg | 81/441 |
| 2,323,018 | 6/1943 | De Vellier | 81/436 |
| 3,894,450 | 7/1975 | Hill et al. | 81/460 |
| 4,209,182 | 6/1980 | Sheldon | 279/75 |
| 4,235,269 | 11/1980 | Kraus | 81/438 |
| 5,295,423 | 3/1994 | Mikic | 81/438 |
| 5,335,409 | 8/1994 | Elvebak | 29/451 |
| 5,351,586 | 10/1994 | Habermehl et al. | 81/438 |
| 5,531,143 | 7/1996 | Habermehl et al. | 81/438 |
| 5,535,648 | 7/1996 | Braun et al. | 81/63.1 |
| 5,570,616 | 11/1996 | Thompson et al. | 81/63.1 |
| 5,873,290 | 2/1999 | Chaconas | 81/436 |

FOREIGN PATENT DOCUMENTS

| | | | |
|---|---|---|---|
| 26619/30 | 5/1930 | Australia | 81/436 |
| 112475 | 8/1899 | Germany | 81/436 |
| 94 00 780 | 3/1994 | Germany . | |
| 43 00 446 | 6/1994 | Germany . | |

*Primary Examiner*—James G. Smith
*Assistant Examiner*—David B. Thomas
*Attorney, Agent, or Firm*—Hayes, Soloway, Hennessey, Grossman & Hage PC

[57] ABSTRACT

A driver bit and a driving tool having a plurality of projections formed on at least one surface of the shank portion/driving portion of the bit/tool to retain the bit in a bit holder, or to retain a socket or the like on the driving tool. The projections are formed such that the geometric envelope of the bit is within the tolerance of the bit holder, so that the bit can be used with standardized holders. When torque is applied to the bit or driving tool, the projections engage the inner surface of a standardized holder/socket, thereby retaining the bit/socket.

23 Claims, 2 Drawing Sheets

DRIVER BIT AND DRIVER

BACKGROUND OF THE INVENTION

1. Field of the Invention

The present invention relates to a driver bit, and more particularly, to a bit with projections on the bit shank to interlock with surfaces of the bit holder to reduce the tendency of the bit to slip out of the bit holder. The present invention also relates to a driver tool, and more particularly, to a driver tool that engages various sockets, the driver having projections on the portion thereof that engages a socket, to interlock with the inner surface of the socket to reduce the tendency of the socket to slip off of the driver.

2. Brief Description of Related Art

Tools having removable bits for engaging and driving various fasteners into a work-piece are known. For example, screwdrivers that have interchangeable, removable bits are known. The prior art is dominated with hexagonal driver bits modified with various fasteners to be used in an appropriately modified bit holder. A clearance is provided between the holder and the driver bit to allow ease of insertion and changing of the bit. Various retention methods that rely on interference fits e.g., rubber o-rings, etc., or mechanical locking mechanism (snap rings, etc.), or magnetic attraction are currently used, but are subject to failure due to breakage, loss of parts, magnetic weakening and wear to the inner surfaces of the bit holder.

U.S. Pat. No. 4,209,182 issued to Sheldon discloses an axially movable sleeve retained in the bore of a portable rotary housing, disposed around a spindle to hold captive a ball key which releasably retains a screwdriver bit. The sleeve is retained in the housing by a spring retainer (or the like), whereby the bit (and the retainer) may be removed and replaced by axial displacement of the sleeve. Two patents from Habermehl et al., U.S. Pat. Nos. 5,351,586 and 5,531,143 disclose a screwdriver with a replacement bit assembly, where the bit is secured to a mandrel that is axially slidable in a socket in the end of the mandrel. These patents teach a split-ring on the bit which serves to retain the bit in the socket.

Driver tools are also known in the art. For example, socket drivers are known to employ a displaceable ball bearing retaining mechanism to hold a plurality of sockets on the driver. However, such mechanism are also prone to wear, which can render the retaining mechanism ineffective. Similar driving devices having both male driving portions (e.g., hex keys, Allen™ wrenches, etc.) and female driving portions (e.g., socket wrenches, etc.) are known, but each suffer from the aforementioned problems associated with screwdriver bits.

Thus, although the prior art discloses various bit and driver retention mechanisms, none of the prior art provides a bit retention mechanism that can be used with standardized holders. Also, prior art devices suffer because there is the need to create complicated retention mechanisms and holders that can break, wear, or are expensive to manufacture.

SUMMARY OF THE INVENTION

Accordingly, the present invention solves the aforementioned drawbacks by providing a bit with a plurality of engaging projections that are formed within the standard geometric envelope of the driver bit, to permit the bit to be manufactured to standard dimensions and to be used with standard bit holders. The present invention also solves the aforementioned drawbacks by providing a driver tool with a plurality of engaging projections that are formed on the engaging surface within the standard geometric envelope of the driver, to permit the tool to be manufactured to standard dimensions and to be used with standard sockets.

Included in the preferred embodiment is a screwdriver bit, comprising a shank portion having a plurality of sides forming a geometric shape with a geometric envelope; a plurality of projections formed on at least one of the sides and being within the geometric envelope; the projections engaging an inner surface of a bit holder to prevent slippage of the bit in the holder. Preferably, the projections have a triangular or sawtooth shape. Also preferably, the projections have a varying height across the surface; wherein the projections vary in height, from smallest height to biggest height, progressively across the surface.

Advantageously, the screwdriver bit of the present invention provides projections that engage the inner surface of the bit holder when torque is applied to the bit, thereby preventing slippage of the bit. Also advantageously, the screwdriver bit of the present invention can be manufactured to the tolerances of the bit holder, so that the bit can be used in any standardized bit holder.

In another embodiment, a driver tool is provided that engages various sockets, the driver having projections (as described above in reference to the first embodiment) on the portion thereof that engages a socket. Advantageously, the driver tool of the present invention provides projections to interlock with the inner surface of the socket to reduce the tendency of the socket to slip off of the driver. Also advantageously, the driver tool of the present invention can be manufactured to the tolerance of standard sockets, so that the driver tool can be used within any standard socket.

It will be appreciated by those skilled in the art that although the following Detailed Description will proceed with reference being made to preferred embodiments, the present invention is not intended to be limited to these preferred embodiments. Rather, the present invention is of broad scope and is intended to be limited as only set forth in the accompanying claims.

Other features and advantages of the present invention will become apparent as the following Detailed Description proceeds, and upon reference to the Drawings, wherein like numerals depict like parts, and wherein:

DETAILED DESCRIPTION OF PREFERRED EMBODIMENTS

Figure 1A:
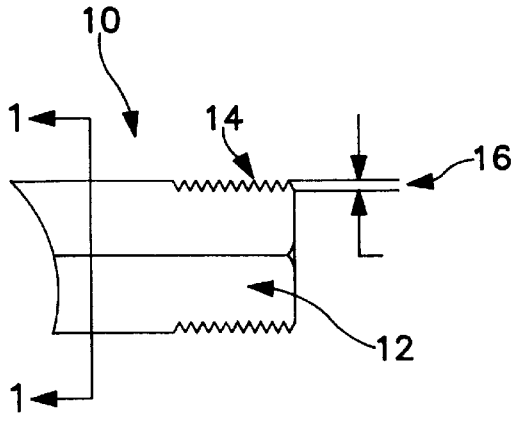
FIG. 1A is an elevated view of the driver bit of the present invention.
Figure 1B:
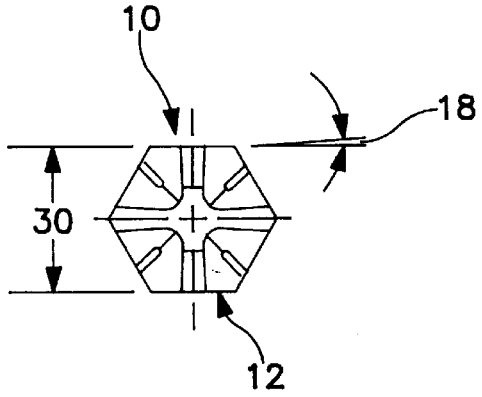
FIG. 1B is a cross-sectional view of the driver bit of the present invention, taken along the reference lines 1—1 of FIG. 1A.

FIGS. 1A and 1B depict elevational and cross-sectional views, respectively, of the driver bit 10 of the present invention. Preferably, the driver bit is a screwdriver bit with a strait or Philips™ head. However, other driver bits are also contemplated herein, for example, Allen™ bits, Torx™ bits, etc. As shown in FIG. 1B, the shank portion of the bit forms a geometric shape (e.g., hexagon, rectangle, etc.), with a plurality of surfaces 12, matching a corresponding bit holder (not shown). Provided on at least one of the surfaces 12 are one or more projections 14 that are formed on the surface 12 to a predetermined depth 16. The projections 14 can be provided across all or part of the surface 12.

Preferably, the projections 14 are provided on the surface 12 to a depth of between 0.002 to 0.004 inches, however, the depth of the projections can be altered without departing from the scope of the present invention. For example, the projections 14 may extend slightly above the surface 12, but within the geometric envelope 30. Also preferably, as shown in FIG. 1B, the projections 14 can vary in height of relief (as depicted by angle 18) across the surface 12. Accordingly, the projections 14 would be of greatest height on the edge of the holder engagable surface where maximum torsional loading occurs when a fastener is being driven by the bit 10. One key feature of the present invention is to provide a bit that can be used with standardized bit holders. Accordingly, the bit 10 of the present invention is formed to an appropriate geometric shape that is within a geometric envelope 30 of the holder to be used. Thus, the bit 10 of the present invention has a geometric envelope 30 (i.e., cross-sectional diameter) that is within the manufacturing tolerance of the bit holder.

Figure 2A:
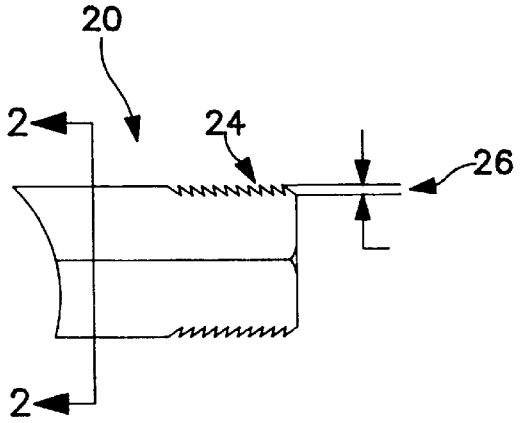
FIG. 2A is an elevated view of another driver bit of the present invention.
Figure 2B:
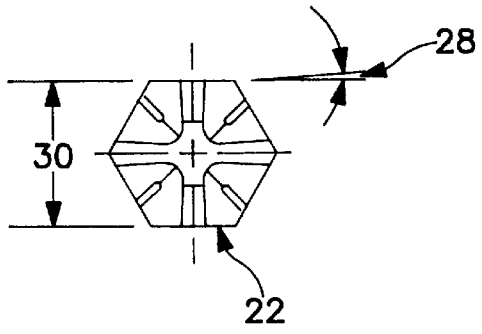
FIG. 2B is a cross-sectional view of the driver bit of the present invention, taken along the reference lines 2—2 of FIG. 2A.

The bit 20 as shown in FIGS. 2A and 2B is similar to the above-described embodiment of FIGS. 1A and 1B, except that the projections 24 are of a different shape. As depicted in FIG. 2A, projections 24 (formed on at least one surface 22) are sawtooth-shaped. Accordingly, depth 26 and angle 28 are adjusted to the dimensions of the projections 24, in accordance with the description set forth above with reference to depth 16 and angle 18.

When rotational force is applied to the bit, the projections 14, 24 engage the inner surface of the holder in such a manner as to prevent slippage of the bit between uses, etc. The bit can be simply removed from the holder by pulling it out.

In another embodiment, and with reference to FIGS. 1A and 2A, a driver tool is provided with projections, as described above with reference to the driver bit, on the engagement end (i.e., male end). The projections are provided to engage the inner surfaces of a socket (or other driving piece). In this case, the shank portion corresponds to a driver portion that engages a socket, or the like. Preferably, the driver 10 and 20 are incorporated into a driver tool, for example, a socket driving tool. Of course, the socket driver can be appropriately modified for a given gage socket set (e.g., ¼ inch drive, ½ inch drive, etc.).

Figure 3:
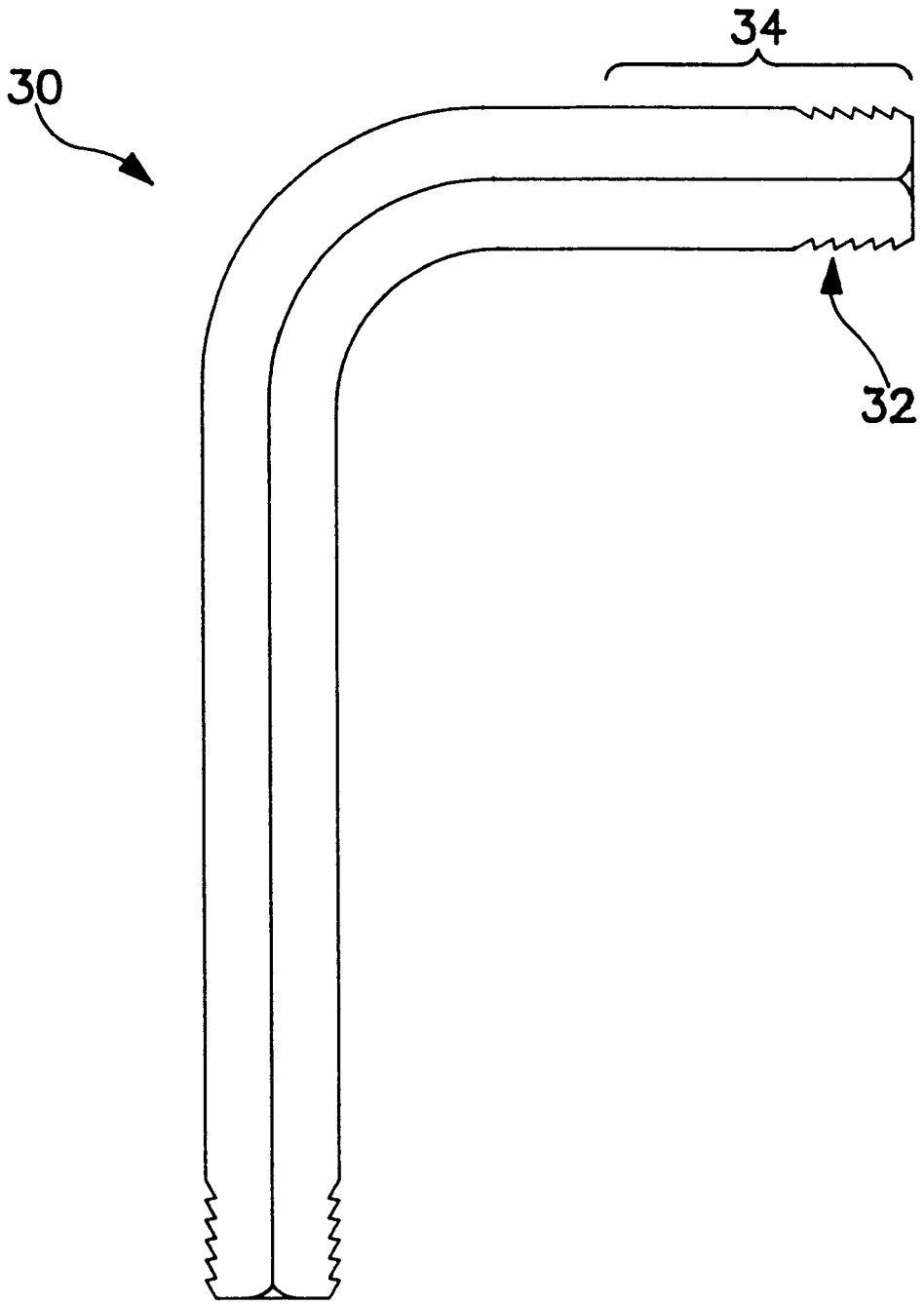
FIG. 3 is a side view of an exemplary driver tool of the present invention.

In another embodiment, a driver tool 30 as shown in FIG. 3, is provided. Similar to the previous embodiments, the projections 32 are formed on the engagement end 34, i.e., the end that is used to drive a socket, or the like. Also similar to the previous embodiments, the driver tool 30 has a geometric envelope (cross-sectional diameter) that is within the manufacturing tolerance of the socket, or other piece. In addition, the projections 32 can vary in height of relief across the surface. It should be noted that although a hex driving tool is shown in FIG. 3, the present invention is not so limited. Indeed the principals set forth herein can be equally applied to the driving portion of a socket wrench (or, for that matter, to the internal (female) engaging portion of a socket), Allen™ wrench, Torx™ wrench, or other similar tools.

Thus, it is evident that there has been provided a driver bit and driver tool that fully satisfies both the aims and objectives hereinbefore set forth. It will be appreciated that although specific embodiments and methods of use have been presented, many modifications, alternatives and equivalents are possible. For example, The bit 10 of the present invention can be modified to be used with other retention mechanisms (e.g., magnetic retention, o-ring, clasp, etc.), to further the retention properties of the bit. Other modifications are also possible. For example, the projections can have different shapes, e.g., spikes, circular indents, etc. without departing from the scope of the present invention. Also, as shown in FIGS. 1A and 2A, the projections are individually formed at an angle with respect to the surface, e.g., angled away from the driving portion of the shank (not to be confused with the relief angles 18 and 28, described above). Of course, the present invention can be modified with other projection angles without departing from the scope of the present invention. In addition, although the bit described above has been in reference to a hexagonal bit, the bit of the present invention can be any geometric cross-sectional shape (e.g., square, rectangle, etc.). The present invention can also be modified to incorporate the projections, as described herein, on the inner surfaces (i.e., female surfaces) of a socket or other driving mechanism.

Thus, advantageously, the present invention a bit and driver tool that can be manufactured easily, and that can be used with bit holders/sockets of standardized dimensions. None of the features of the present invention are disclosed anywhere in the prior art.

What is claimed is:

1. A driver bit, comprising a shank portion having a plurality of surfaces forming a geometric shape; a plurality of projections formed on at least a part of at least one of said surfaces; said projections (a) varying in height across said surface, and (b) engaging an inner surface of a bit holder to prevent slippage of said bit in said holder.

2. A driver bit as claimed in claim 1, wherein said projections have a triangular shape.

3. A driver bit as claimed in claim 1, wherein said projections have a sawtooth shape.

4. A driver bit as claimed in claim 1, wherein said geometric shape is a hexagon and said projections are within the cross-sectional diameter of said hexagon, plus or minus manufacturing tolerances.

5. A driver bit as claimed in claim 1, wherein said geometric shape is a rectangle and said projections are within the cross-sectional diameter of said rectangle, plus or minus manufacturing tolerances.

6. A driver bit as claimed in claim 1, wherein said variation in height of said projections is about 0.002 inches to 0.004 inches.

7. A driver bit as claimed in claim 1, wherein said projections vary in height, from smallest height to biggest height, progressively across said surface.

8. A screwdriver bit as claimed in claim 1, wherein said projections engage said inner surface of said bit holder when torque is applied to said bit.

9. A driver bit as claimed in claim 1, wherein said shank portion being manufactured to the tolerance of said bit holder.

10. A driver bit as claimed in claim 1, wherein said projections being formed at an angle with respect to said surface.

11. A driver bit as claimed in claim 1, wherein said driver bit includes a screwdriver bit.

12. A driver bit as claimed in claim 1, wherein said driver bit includes a multi-faceted, star-shaped driver bit.

13. A driver bit as claimed in claim 1, wherein said driver bit includes a hexagonal shaped bit.

14. A driving tool for engaging a socket or the like, comprising a driver portion having a plurality of surfaces forming a geometric shape; a plurality of projections formed on at least a part of at least one of said surfaces; said projections (a) varying in height across said surface, and (b) engaging an inner surface of a socket to prevent slippage of said socket from said driver portion.

15. A driver tool as claimed in claim 14, wherein said projections have a triangular shape.

16. A driver bit as claimed in claim 14, wherein said projections have a sawtooth shape.

17. A driving tool as claimed in claim 14, wherein said geometric shape is a hexagon and said projections are within the cross-sectional diameter of said hexagon, plus or minus manufacturing tolerances.

18. A driving tool as claimed in claim 14, wherein said geometric shape is a rectangle and said projections are within the cross-sectional diameter of said rectangle, plus or minus manufacturing tolerances.

19. A driving tool as claimed in claim 14, wherein said variation in height of said projections is about 0.002 inches to 0.004 inches.

20. A driving tool as claimed in claim 14, wherein said projections vary in height, from smallest height to biggest height, progressively across said surface.

21. A driving tool as claimed in claim 14, wherein said projections engage said inner surface of said socket when torque is applied to said driving tool.

22. A driving tool as claimed in claim 14, wherein said driving portion being manufactured to the tolerance of said socket.

23. A driving tool as claimed in claim 14, wherein said projections being formed at an angle with respect to said surface.

* * * * *